US009379473B2

(12) United States Patent
Okamoto et al.

(10) Patent No.: US 9,379,473 B2
(45) Date of Patent: Jun. 28, 2016

(54) CONNECTOR

(75) Inventors: Ryoya Okamoto, Yokkaichi (JP); Hiroomi Hiramitsu, Yokkaichi (JP); Hiroki Hirai, Yokkaichi (JP); Masakuni Kasugai, Osaka (JP)

(73) Assignees: AutoNetworks Technologies, Ltd., Yokkaichi, Mie (JP); SUMITOMO ELECTRIC INDUSTRIES, LTD., Osaka-shi, Osaka (JP); Sumitomo Wiring Systems, Ltd., Yokkaichi, Mie (JP)

( * ) Notice: Subject to any disclaimer, the term of this patent is extended or adjusted under 35 U.S.C. 154(b) by 145 days.

(21) Appl. No.: 14/009,393

(22) PCT Filed: Apr. 9, 2012

(86) PCT No.: PCT/JP2012/059659
§ 371 (c)(1),
(2), (4) Date: Oct. 2, 2013

(87) PCT Pub. No.: WO2012/144364
PCT Pub. Date: Oct. 26, 2012

(65) Prior Publication Data

US 2014/0024262 A1 Jan. 23, 2014

(30) Foreign Application Priority Data

Apr. 18, 2011 (JP) ..... 2011-091639

(51) Int. Cl.

| | |
|---|---|
| ***H01R 13/60*** | (2006.01) |
| ***H01R 13/514*** | (2006.01) |
| ***H01R 13/518*** | (2006.01) |
| ***H01R 13/629*** | (2006.01) |
| *H01R 13/627* | (2006.01) |

(52) U.S. Cl.
CPC ..... *H01R 13/514* (2013.01); *H01R 13/518* (2013.01); *H01R 13/629* (2013.01); *H01R 13/6272* (2013.01)

(58) Field of Classification Search
CPC .. H01R 13/518; H01R 13/514; H01R 13/506; H01R 23/025; H01R 23/688
USPC ..... 439/595, 701, 752
See application file for complete search history.

(56) References Cited

U.S. PATENT DOCUMENTS 4,997,386 A * 3/1991 Kawachi et al. ..... 439/352
(Continued)

FOREIGN PATENT DOCUMENTS

| | | |
|---|---|---|
| JP | 09306582 | 11/1997 |
| JP | 11-299054 | 10/1999 |

(Continued)

OTHER PUBLICATIONS

European Patent Appl. No. 12 774 520.6—Search Report issued Dec. 5, 2014.

*Primary Examiner* — Hien Vu
(74) *Attorney, Agent, or Firm* — Gerald E. Hespos; Michael J. Porco; Matthew T. Hespos

(57) ABSTRACT

A connector includes a plurality of cavities (12) into which terminal fittings are to be accommodated. The cavities (12) are separate tubular members independent of a connector main body (14) and each of the cavities (12) also is configured as a separate member independent of the other cavities. The connector main body (14) functions as a holder for accommodating the plurality of cavities (12) and the cavities (12) are locked individually in the connector main body (14). Clearances are provided between the individual cavities (12) and the connector main body (14) in these locked parts and the cavities (12) are permitted to move relative to the connector main body (14) due to the clearances.

13 Claims, 16 Drawing Sheets

(56) References Cited

U.S. PATENT DOCUMENTS

| | | | | |
|---|---|---|---|---|
| 5,184,961 | A * | 2/1993 | Ramirez et al. | 439/59 |
| 5,569,040 | A * | 10/1996 | Sumida | 439/157 |
| 6,095,852 | A * | 8/2000 | Gregory, II | 439/540.1 |
| 7,118,414 | B2 * | 10/2006 | Spears et al. | 439/540.1 |
| 2007/0004274 | A1 | 1/2007 | Tabata et al. | |

FOREIGN PATENT DOCUMENTS

| | | |
|---|---|---|
| JP | 2001-237028 | 8/2001 |
| JP | 2007-242251 | 9/2007 |
| JP | 2008-198429 | 8/2008 |
| JP | 2008-293810 | 12/2008 |
| WO | 9632761 | 10/1996 |

* cited by examiner

10

12

12

14

10

10

LEFT ⟷ RIGHT

10

CONNECTOR

BACKGROUND

1. Field of the Invention

This invention relates to a connector including a plurality of cavities into which terminal fittings connected to wire ends are to be accommodated and more particularly to a connector preferably used as a connector to be connected to a plurality of mating connectors provided in stacked members.

2. Description of the Related Art

A connector for electrical connection to a power supply or another electric/electronic device (member) is provided in an electric/electronic device (member). For example, in Japanese Unexamined Patent Publication No. H11-299054, busbars and tab terminals are provided on a wiring board of an electrical connection box and a connector in which these busbars and tab terminals are accommodated in a connector housing integrally formed to a main cover for covering this wiring board is provided in the electrical connection box.

For example, in the case of using a plurality of electric/electronic devices (members) having a similar configuration, these electric/electronic devices are stacked or arranged side by side in some cases. For example, when these members are in the form of flat plates such as substrates, they are particularly stacked. In the case of using a plurality of electric/electronic devices (members) having a similar configuration while stacking them, respective connectors are stacked at the same position on the same side of the members since these members have a similar configuration.

At this time, the connectors of the stacked members are designed to be stacked at predetermined intervals designed beforehand. However, the intervals between the connectors of the stacked members are actually often subject to a stacking tolerance due to design tolerances of the respective members.

Thus, in the case of collectively connecting these connectors by a connector, the connector has to be connected in view of the stacking tolerance present on the stacked members. At this time, it is very difficult to correct the tolerance on the staked members and, even if it is possible, it may lead to a considerable cost increase. Therefore, it has not been possible to collectively connect these connectors by a conventional connector.

A problem sought to be solved by the present invention is overcome by providing a connector capable of collectively connecting mating connectors provided in respective electric/electronic devices (members) even if there is a stacking tolerance on the stacked devices (members).

SUMMARY OF THE INVENTION

To solve the above problem, the present invention is directed to a connector including a plurality of cavities into which terminal fittings connected to wire ends are to be accommodated, wherein the cavities are configured into tubular members as separate members independent of a connector main body and each of the plurality of cavities is also configured as a separate member independent of the other cavities; the connector main body serves as a holder for accommodating the plurality of cavities and the plurality of cavities are individually locked in the connector main body; and clearances are provided between the individual cavities and the connector main body in locked parts and the cavities are permitted to move relative to the connector main body by the clearances.

At this time, the connector main body preferably includes a plurality of locking holes into which the cavities are to be inserted to be locked and a cover provided at a position to be located behind the inserted cavities for preventing the detachment of the inserted cavities from the connector main body.

At this time, a clearance for permitting the inserted cavities to move relative to the connector main body is preferably provided between the inserted cavities and the cover.

In the connector according to the present invention, there is desirably a reference cavity whose movement relative to the connector main body is restricted.

Here, the reference cavity can be integrally molded to the connector main body, whereby the movement thereof relative to the connector main body is restricted.

Further, the reference cavity can be press-fitted into the connector main body, whereby the movement thereof relative to the connector main body is restricted.

Further, the reference cavity can be integrally molded to the cover, whereby the movement thereof relative to the connector main body is restricted.

Further, the reference cavity can be pressed by the cover, whereby the movement thereof relative to the connector main body is restricted.

Preferably, the cover is formed with a through hole through which wires connected to the terminal fittings to be accommodated into the cavities are passed and a guide groove for determining a wiring direction of the wires communicates with the through hole.

The connector according to the present invention preferably collectively connects a plurality of mating connectors provided in respective stacked members and set in a stacked state.

According to the connector according to the present invention, the individual cavities are permitted to move relative to the connector main body by the clearances in the locked parts between the individual cavities independent of the connector main body and the connector main body. Thus, in collectively connecting the mating connectors provided in respective stacked electric/electronic devices (members), the individual cavities can be positioned with respect to the individual mating connectors, into which the individual cavities are to be fitted, by being moved even if there is a stacking tolerance between the mating connectors stacked in the stacked electric/electronic devices (members), and that stacking tolerance can be absorbed. This enables the stacked mating connectors to be collectively connected by the connector.

At this time, if the connector main body includes the plurality of locking holes into which the cavities are inserted to be locked and the cover provided at a position to be located behind the inserted cavities for preventing the detachment of the inserted cavities from the connector main body, the cavities can be reliably locked in the connector main body.

At this time, if the clearance for permitting the inserted cavities to move relative to the connector main body is provided between the inserted cavities and the cover, a state where the cavities are permitted to move can be maintained also when the cover is provided.

If the reference cavity whose movement relative to the connector main body is restricted is present in the connector according to the present invention, the connector can be more easily connected to the mating connectors based on the reference cavity.

If the cover is formed with the through hole through which the wires connected to the terminal fittings to be accommodated into the cavities are passed and the guide groove for determining the wiring direction of the wires communicates with this through hole, the wiring direction of the wires can be restricted.

DETAILED DESCRIPTION OF THE PREFERRED EMBODIMENTS

Figure 1:
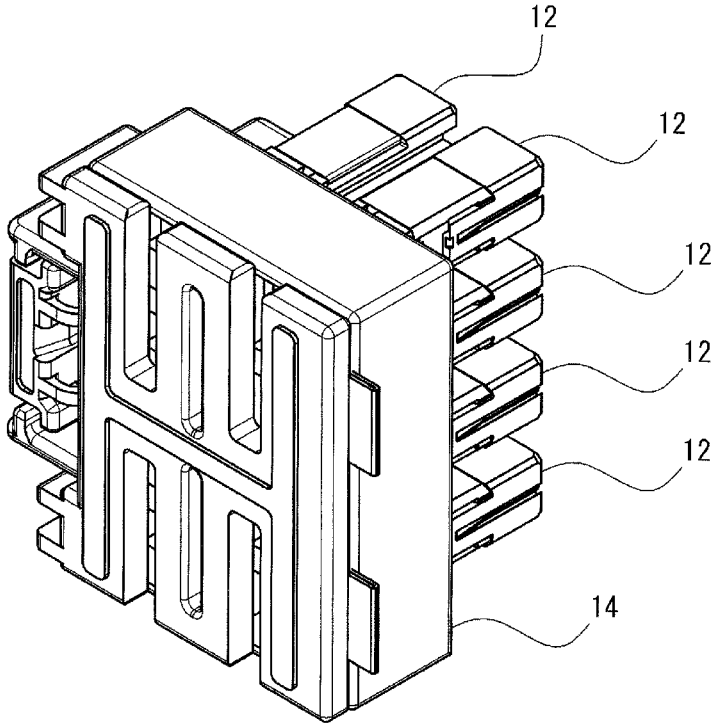
FIG. 1 is an external perspective view of a connector according to one embodiment of the present invention.
Figure 1:
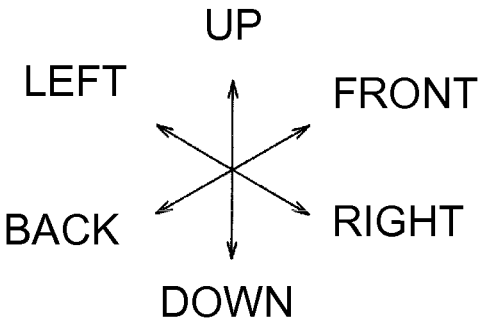

Hereinafter, one embodiment of the present invention is described in detail with reference to the drawings. FIG. 1 is an external perspective view of a connector according to one embodiment of the present invention. Note that forward and backward, vertical and lateral directions of the connector are specified as shown in FIG. 1 in the respective drawings for convenience. A side to be connected to mating connectors is referred to as a front side.

As shown in FIG. 1, a connector 10 according to one embodiment of the present invention includes a plurality of cavities 12 into which terminal fittings connected to wire ends are to be accommodated, and a connector main body 14. The plurality of cavities 12 are configured into tubular members as separate members independent of the connector main body 14. Further, each of the plurality of cavities 12 is also configured as a separate member independent of the other cavities 12. The connector main body 14 is a holder for accommodating these plurality of cavities 12 (hereinafter, the connector main body 14 may be expressed as a holder 14).

Figure 2:
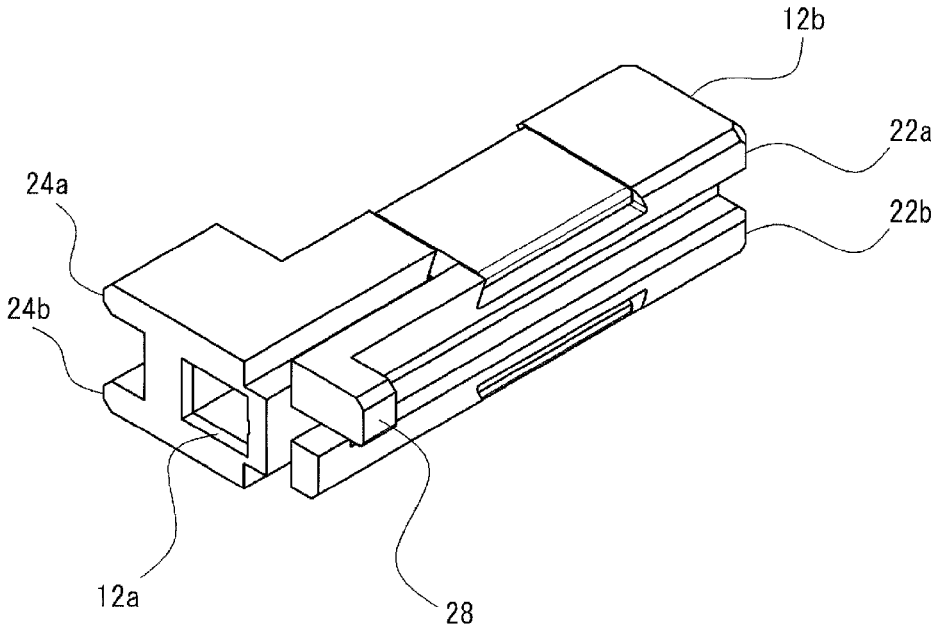
FIG. 2 is an external perspective view of a cavity of the connector.
Figure 2:
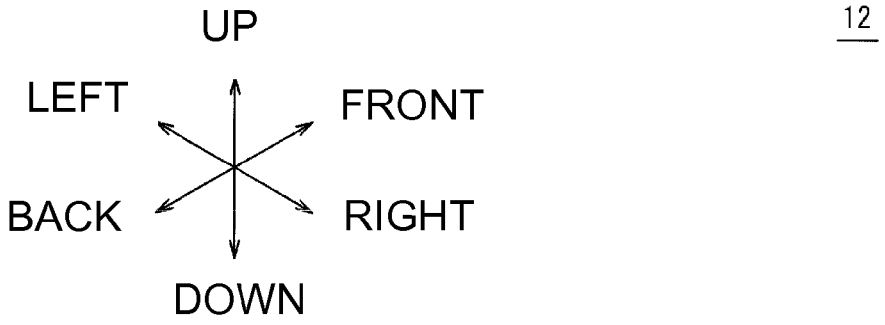
Figure 3:
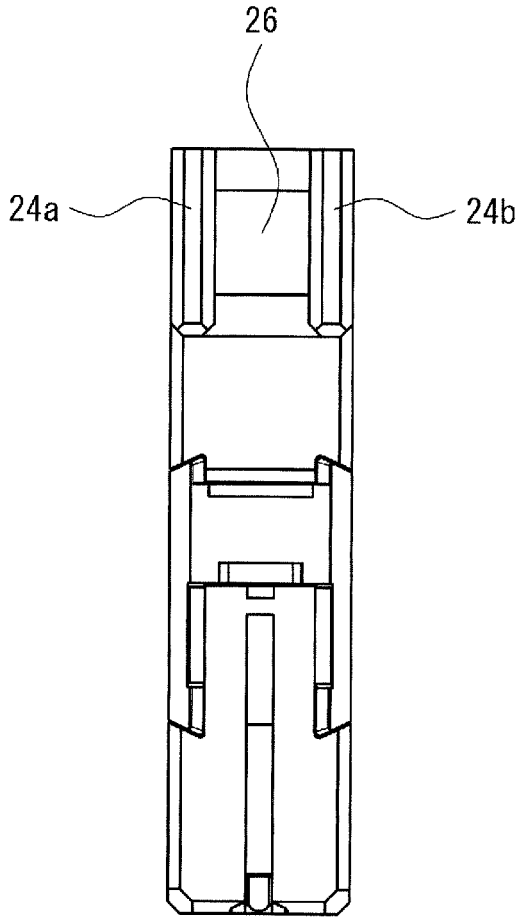
FIG. 3 is a left side view of the cavity of the connector.
Figure 4:
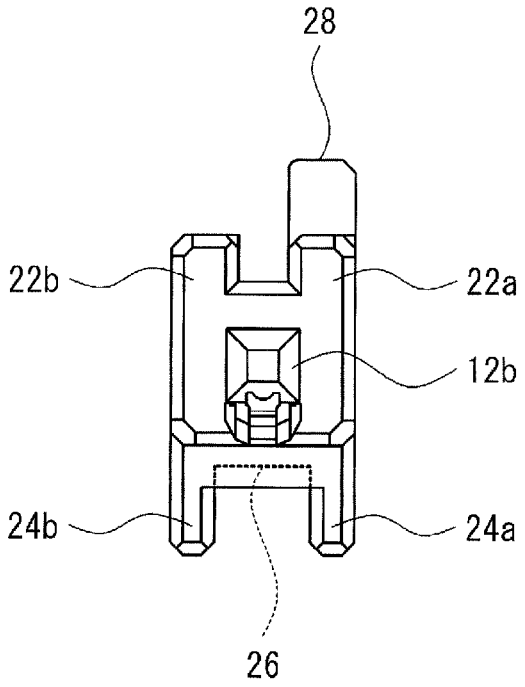
FIG. 4 is a front view of the cavity of the connector.
Figure 5:
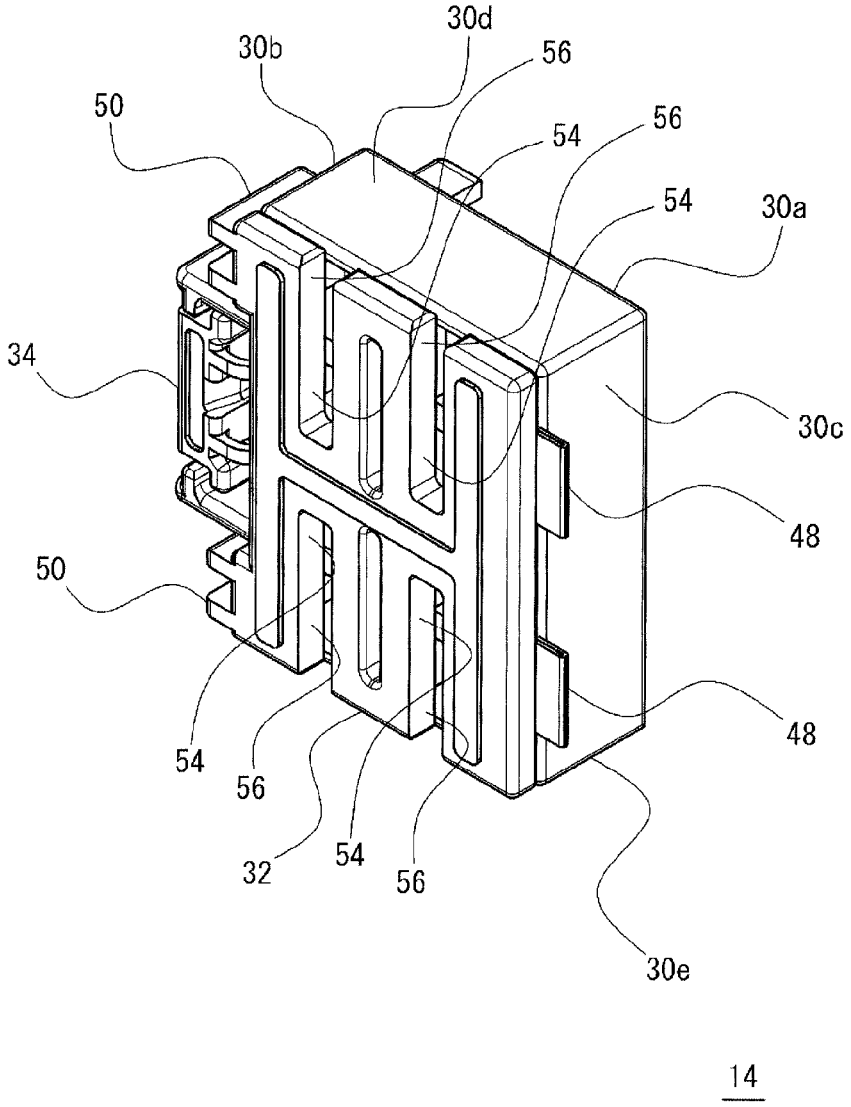
FIG. 5 is an external perspective view showing a holder (connector main body) of the connector.
Figure 6:
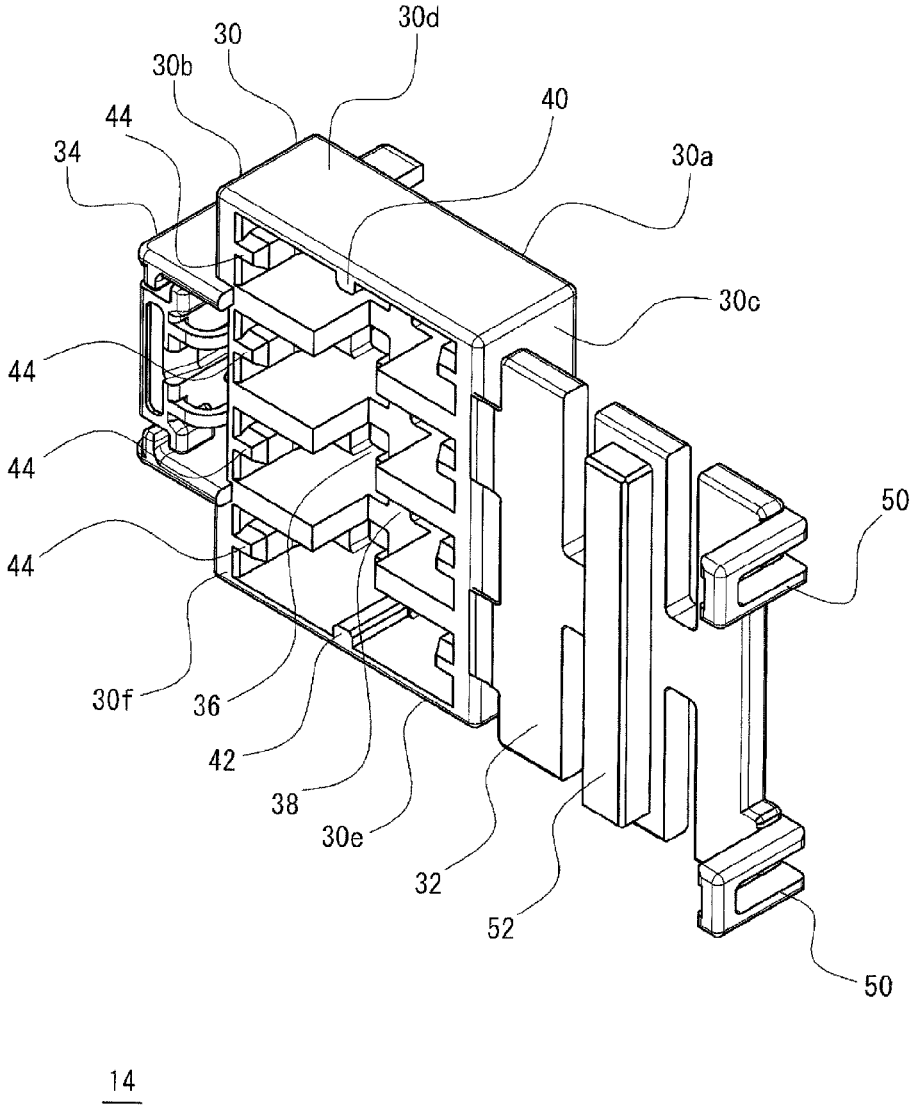
FIG. 6 is an external perspective view of the holder in a state where the interior thereof is visible.
Figure 7:
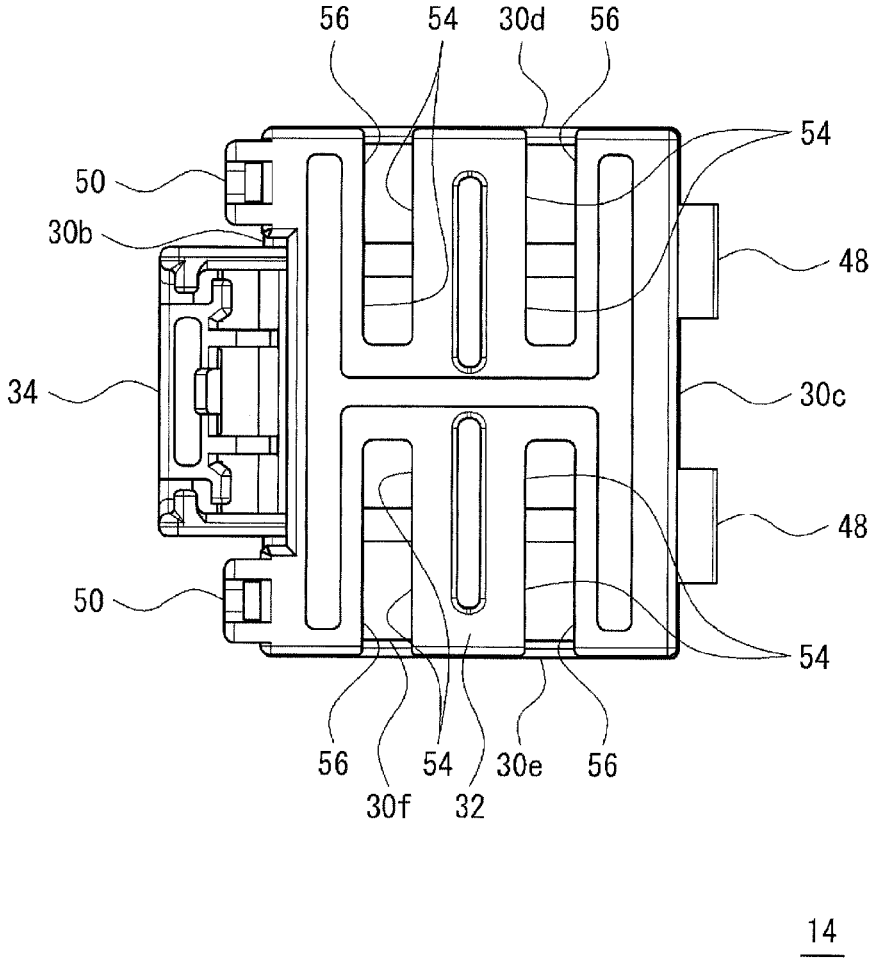
FIG. 7 is a rear view of the holder of the connector.
Figure 8:
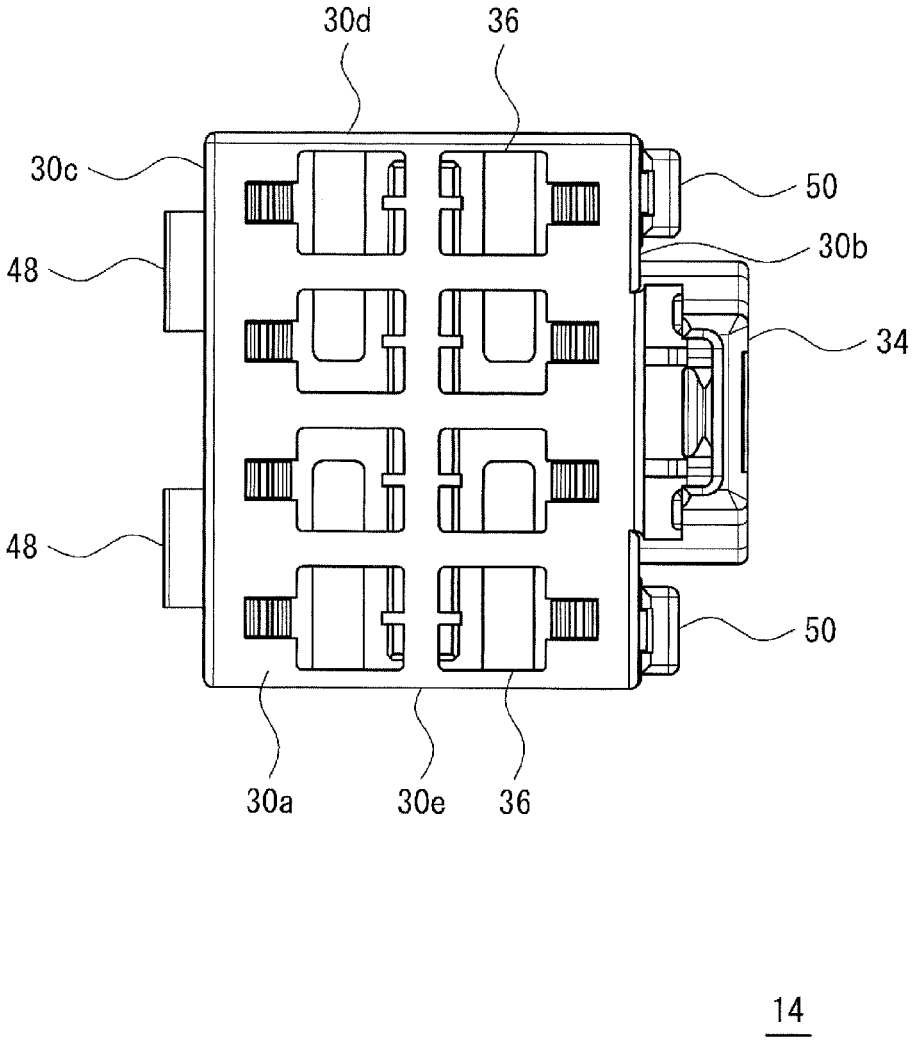
FIG. 8 is a front view of the holder of the connector.
Figure 9:
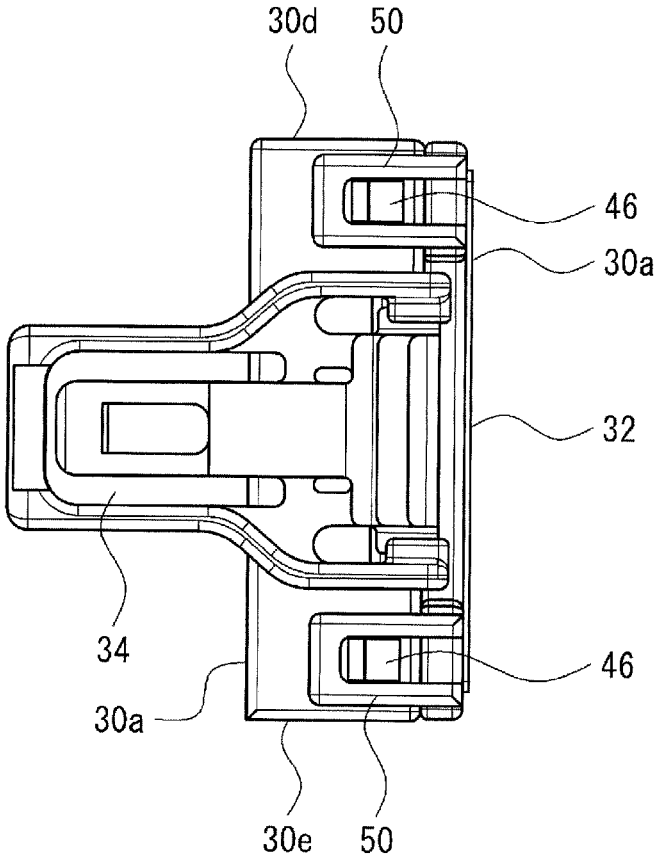
FIG. 9 is a left side view of the holder of the connector.

FIGS. 2 to 4 are views showing the cavity 12 of the connector 10. FIG. 2 is an external perspective view of the cavity 12, FIG. 3 is a left side view of the cavity 12, and FIG. 4 is a front view of the cavity. FIGS. 5 to 9 are views showing the holder 14 (connector main body 14). FIG. 5 is an external perspective view of the holder 14, FIG. 6 is an external perspective view showing the holder 14 in a state where the interior thereof is visible, FIG. 7 is a rear view of the holder 14, FIG. 8 is a front view of the holder 14, and FIG. 9 is a left side view of the holder 14.

As shown in FIGS. 2 to 4, the cavity 12 is in the form of a rectangular tube so that the unillustrated terminal fitting can be accommodated therein. The terminal fitting is locked in the cavity 12 by being engaged with an unillustrated locking projection in the cavity 12. A rear opening side 12*a* of the cavity 12 is a side on which the terminal fitting (tubular terminal 70 to be described later) is to be inserted, and a front opening side 12*b* of the cavity 12 is a side on which a terminal (pin terminal 62) of a mating connector 60 to be described later is to be inserted. Both the rear opening side 12*a* and the front opening side 12*b* of the cavity 12 are tapered to widen entrances so that the terminal fittings (tubular terminal 70 and pin terminal 62 to be described later) can be easily inserted.

A pair of elongated guide ribs 22*a*, 22*b* extending over the entire length of the cavity 12 in forward and backward directions are formed on one side (right side of FIG. 2) of the cavity 12. Further, a pair of elongated guide ribs 24*a*, 24*b* extending only over a part of the rear side of the cavity 12 are formed on the other side (left side of FIG. 2) of the cavity 12. The cavity 12 can be easily inserted into the holder 14 by being guided along a groove between the pair of elongated guide ribs 22*a*, 22*b* on the one side and a groove between the pair of elongated guide ribs 24*a*, 24*b* on the other side.

A lance locking hole 26 is formed by slightly recessing a central part of the groove between the pair of elongated guide ribs 24*a*, 24*b* on the other side, and a locking lance 44 of the holder 14 to be described later is fit therein to be locked.

A stopper 28 in the form of a projection projecting further rightward is formed on the rear end of the upper elongated guide ribs 22*a* out of the pair of elongated guide ribs 22*a*, 22*b* on the one side, and comes into contact with a contacting elongated projection 38 of the holder 14 to be described later.

As shown in FIGS. 5 to 9, the holder 14 includes a box-shaped holder main body 30 enclosed by a front surface 30*a*, opposite side surfaces 30*b*, 30*c* and upper and lower surfaces 30*d*, 30*e* and having an opening rear side 30*f*, a cover 32 for covering the open rear side 30*f* of the holder main body 30, and a lock 34 for locking the mating connectors when the holder 14 is fitted to the mating connectors.

The interior of the holder main body 30 serves as an accommodation chamber for accommodating parts of the cavities 12 not fitted into the mating connectors. A plurality of window-like insertion holes 36 into which the individual cavities 12 are to be so inserted that parts of the accommodated cavities 12 to be fitted into the mating connectors project from the holder main body 30 are formed to penetrate through the front surface 30*a* of the holder main body 30. In a configuration shown in FIGS. 5 to 9, two insertion holes 36 are arranged side by side in the lateral direction and four insertion holes 36 are arranged side by side in the vertical direction.

Between two insertion holes 36 arranged side by side in the lateral direction, the contacting elongated projection 38 with which the stoppers 28 of the cavities 12 are brought into contact is formed to project inwardly of the front surface 30*a* of the holder main body 30 and to be continuous along the vertical direction. This contacting elongated projection 38 also functions as a rib for reinforcing the front surface 30*a* of the holder main body 30 and is linked to upper and lower ribs 40, 42 for similarly reinforcing the upper and lower surfaces 30*d*, 30*e* of the holder main body 30. The locking lances 44, which are to be fitted into the lance locking holes 26 of the cavities 12 to be locked when the cavities 12 are inserted, are provided on the inner sides of the both side surfaces 30*b*, 30*c* of the holder main body 30. Further, engaging claws 46 to be engaged with engaging pieces 50 of the cover 32 to be described later are provided on the outer side of the left side surface 30*b* of the holder main body 30.

The cover 32 is linked to the right rear end of the holder main body 30 by hinges 48 at two positions provided on a right end part. The cover 32 is rotatable about the hinges 48. By the rotation of the cover 32, an opening of the rear side 30*f* of the holder main body 30 can be opened and closed. The engaging pieces 50 to be engaged with the engaging claws 46 formed on the outer side of the left side surface 30*b* of the holder main body 30 are provided at two upper and lower positions of a left end part of the cover 32. When the cover 32 covers the rear side 30*f* of the holder main body 30, the engaging claws 46 of the holder main body 30 and the engaging pieces 50 are engaged, whereby a state where the rear side 30*f* of the holder main body 30 is covered by the cover 32 is maintained.

An elongated projection 52 extending along the vertical direction is formed on a central part of the inner surface of the cover 32. When the cover 32 covers the rear side 30*f* of the holder main body 30, the elongated projection 52 faces the rear end surfaces of the projection-like stoppers 28 formed on the rear ends of the cavities 12 inserted in the insertion holes 36 of the holder 14 with a predetermined gap (clearance) defined therebetween.

Through holes 54 through which the wires connected to the terminal fittings accommodated in the cavities 12 are passed are formed on opposite sides of a part of the cover 32 where the elongated projection 52 is formed. These through holes 54 face the rear opening sides 12*a* of the cavities 12 and the terminal fittings connected to the wire ends are accommodated into the cavities 12 through these through holes 54. Alternatively, the wires W connected to the terminal fittings accommodated in the cavities 12 are pulled out of the connector 10 through the through holes 54. Guide grooves 56 extending upward or downward communicate with these through holes 54, and wiring directions of the wires W from these through holes 54 can be restricted in an upward or downward direction by the guide grooves 56.

The lock 34 is integrally formed to the holder main body 30 on the outer side of the left side surface 30*b* of the holder main body 30. When the connector 10 is connected to the mating connectors, a connected state can be maintained by the lock 34.

Figure 10:
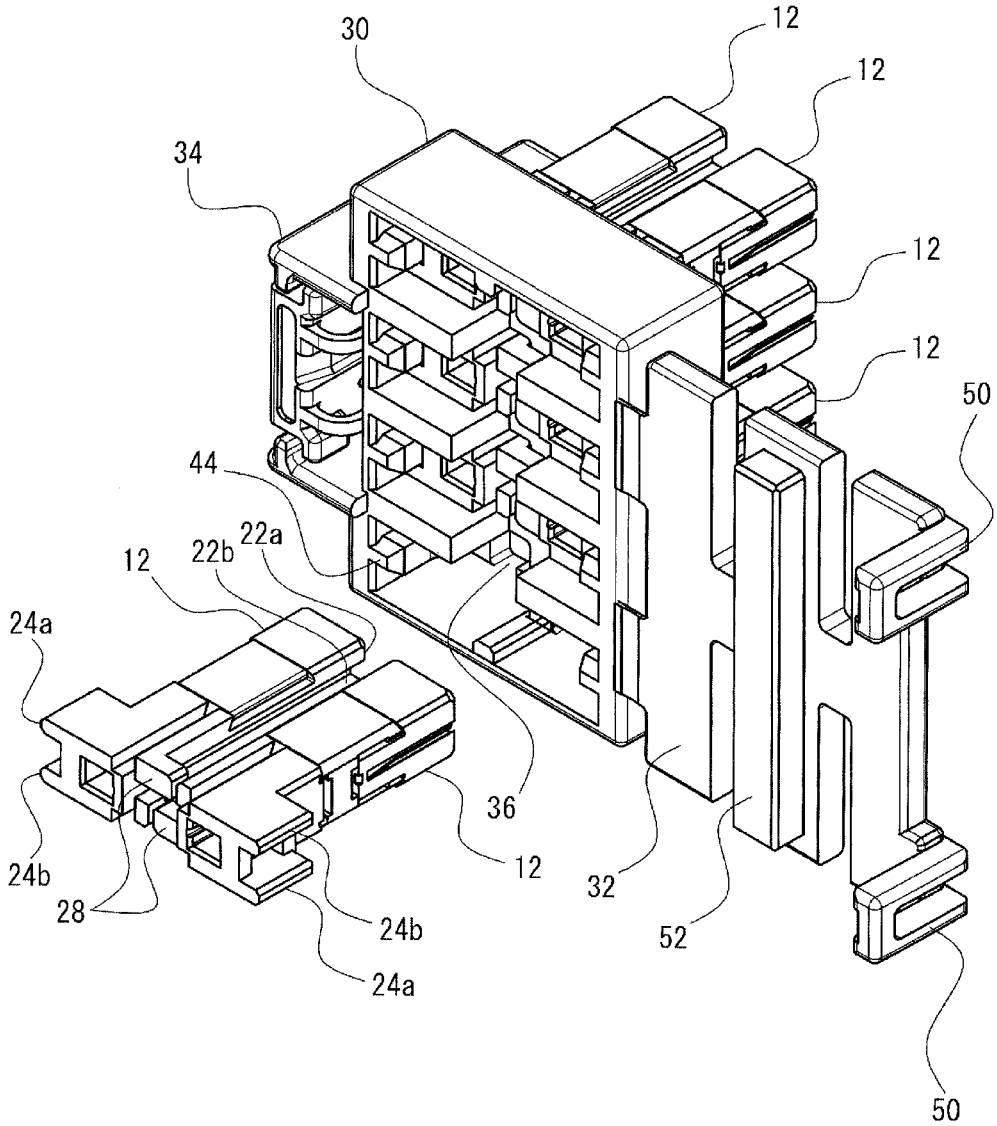
FIG. 10 is a view showing a state where the cavities are being inserted into some insertion holes of the holder.

FIG. 10 shows a state where the cavities 12 are being inserted into some insertion holes 36 of the thus configured holder 14.

On the cavity 12 to be inserted into the left insertion hole 36, the pair of elongated guide ribs 22*a*, 22*b* on the one side are arranged on the right side and the pair of elongated guide ribs 24*a*, 24*b* on the other side are arranged on the left side. Contrary to this, on the cavity 12 to be inserted into the right insertion hole 36, the pair of elongated guide ribs 22*a*, 22*b* on the one side are arranged on the left side and the pair of elongated guide ribs 24*a*, 24*b* on the other side are arranged on the right side. This causes the projection-like stopper 28 of the cavity 12 to be inserted into the left insertion hole 36 to be arranged at an upper side and the projection-like stopper 28 of the cavity 12 to be inserted into the right insertion hole 36 to be arranged at a lower side. Since a pair of these stoppers 28 are arranged to overlap in the vertical direction, a lateral dimension of the connector 10 can be reduced.

Figure 11:
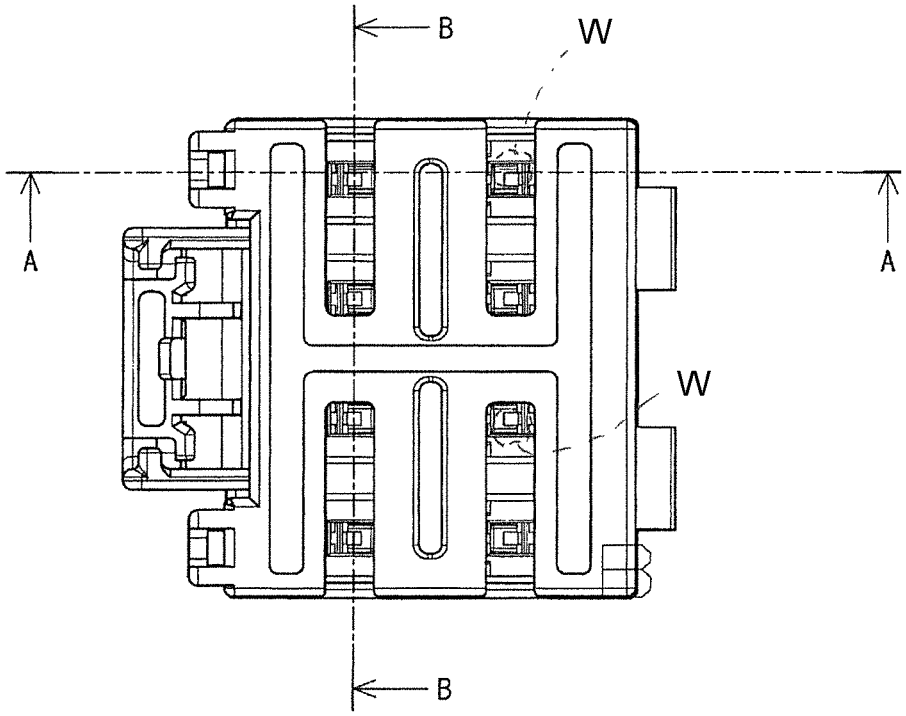
FIG. 11 is a rear view of the connector according to one embodiment of the present invention.
Figure 12:
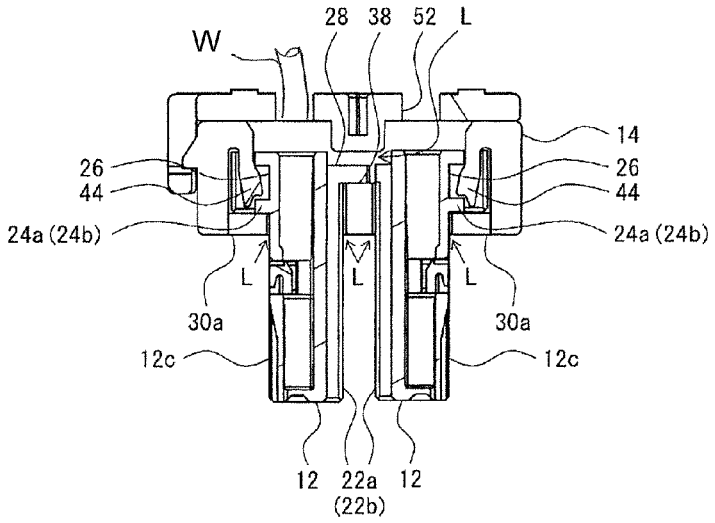
FIG. 12 is a section along A-A of the connector of FIG. 11.
Figure 13:
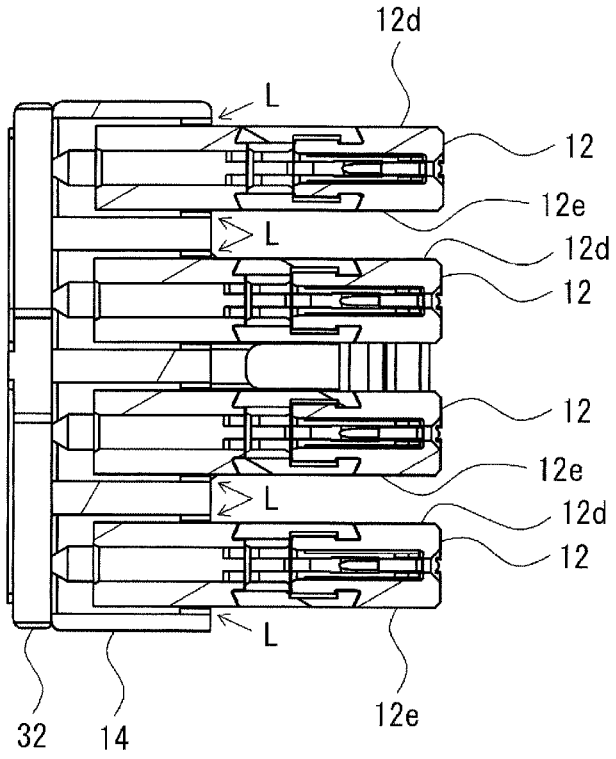
FIG. 13 is a section along B-B of the connector of FIG. 11.
Figure 13:
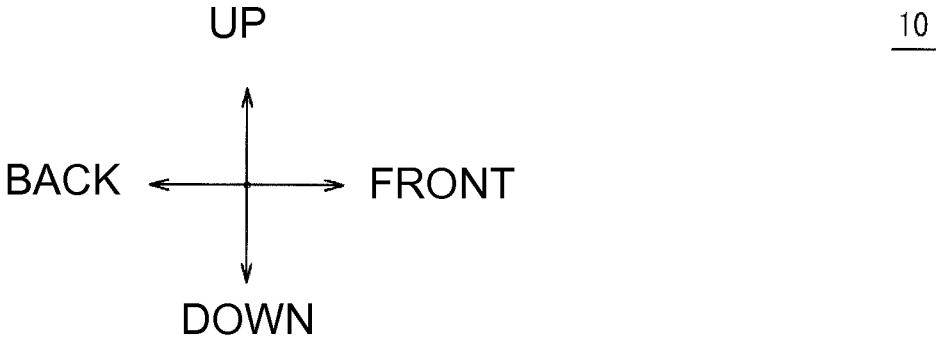
Figure 14:
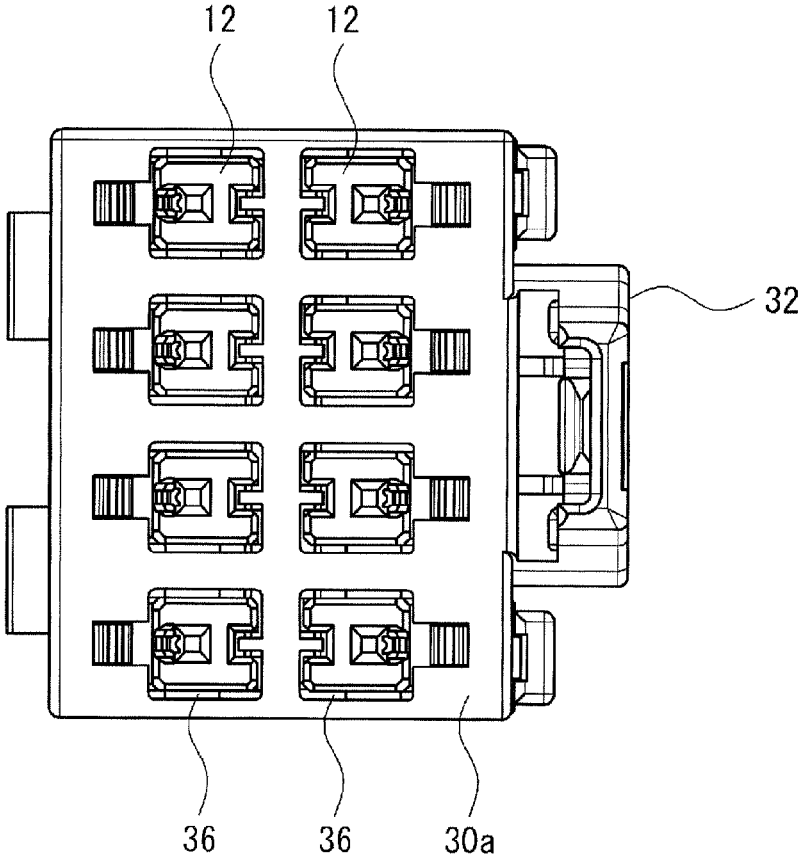
FIG. 14 is a front view of the connector according to one embodiment of the present invention.

FIGS. 11 to 14 are views showing the connector 10 in a completed form in which the cavities 12 are inserted in the insertion holes 36 of the holder 14. FIG. 11 is a rear view of the connector 10, FIG. 12 is a section along A-A of the connector 10 of FIG. 11, FIG. 13 is a section along B-B of the connector 10 of FIG. 11, and FIG. 14 is a front view of the connector 10.

As shown in FIG. 12, the cavity 12 inserted in the insertion hole 36 of the holder 14 is locked in the holder 14 by the fitting engagement of the locking lance 44 of the holder 14 and the lance locking hole 26 of the cavity 12. At this time, the pair of the elongated guide ribs 24*a*, 24*b* on the other side including the lance locking hole 26 of the cavity 12 are held in contact with the front surface 30*a* of the holder main body 30 and the stopper 28 of the cavity 12 is held in contact with the contacting elongated projection 38 of the holder 14.

In this locked part, a clearance L is provided between a side surface 12*c* of the cavity 12 formed with the lance locking hole 26 and the insertion hole 36 of the holder 14. Further, a clearance L is provided between the pair of elongated guide ribs 22*a*, 22*b* of the cavity 12 on the one side including the stopper 28 and the contacting elongated projection 38 of the holder 14. Further, a clearance L is provided between the stopper 28 of the cavity 12 and the elongated projection 52 on the inner surface of the cover 32. Further, as shown in FIG. 13, clearances L are provided between an upper surface 12*d* of the cavity 12 and the insertion hole 36 of the holder 14 and between a lower surface 12*e* of the cavity 12 and the insertion hole 36 of the holder 14 in a locked part of the cavity 12 inserted in the insertion hole 36 of the holder 14. The cavity 12 is permitted to move relative to the holder 14 by these clearances L.

Figure 15:
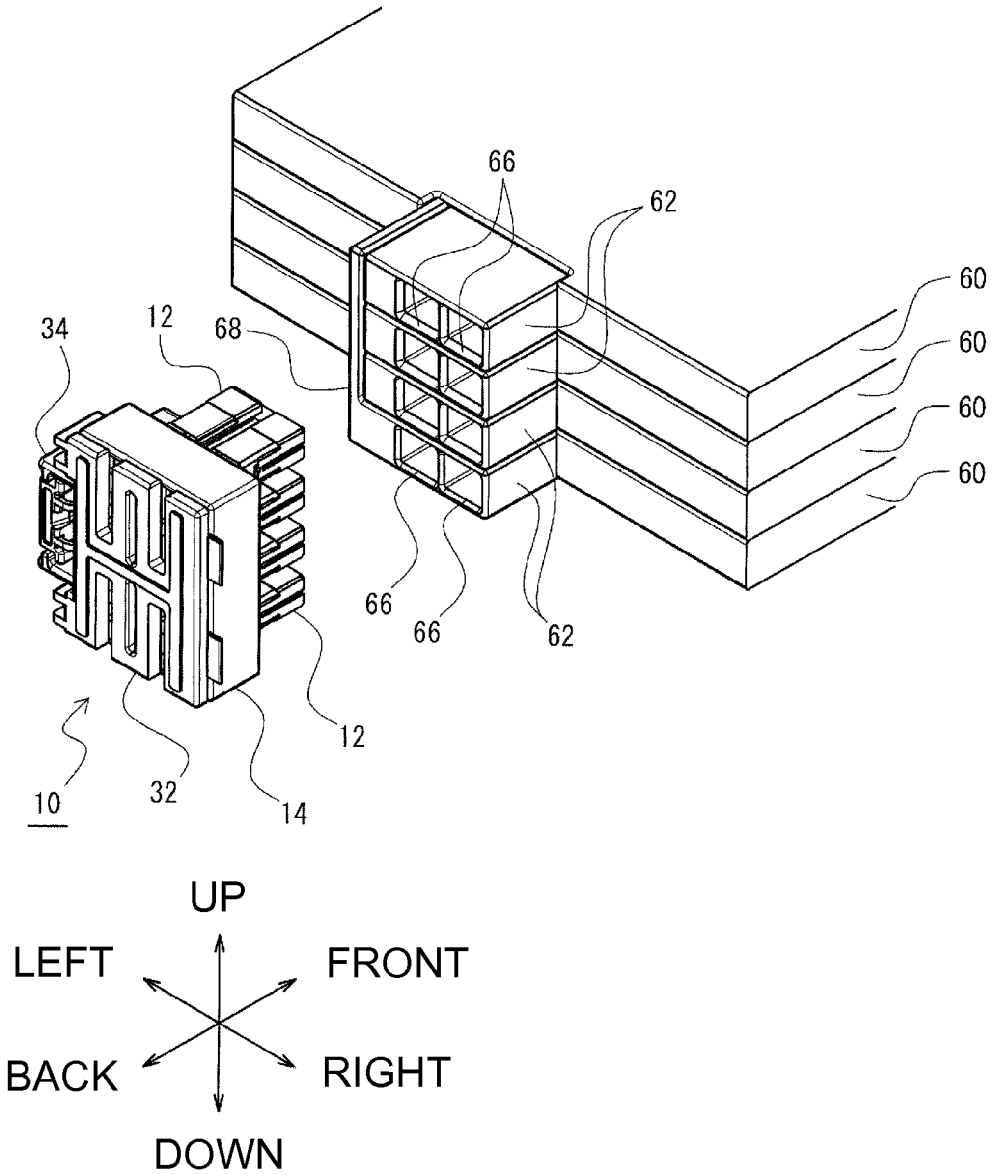
FIG. 15 is a view showing a state before the connector of the present invention is connected to mating connectors.
Figure 16:
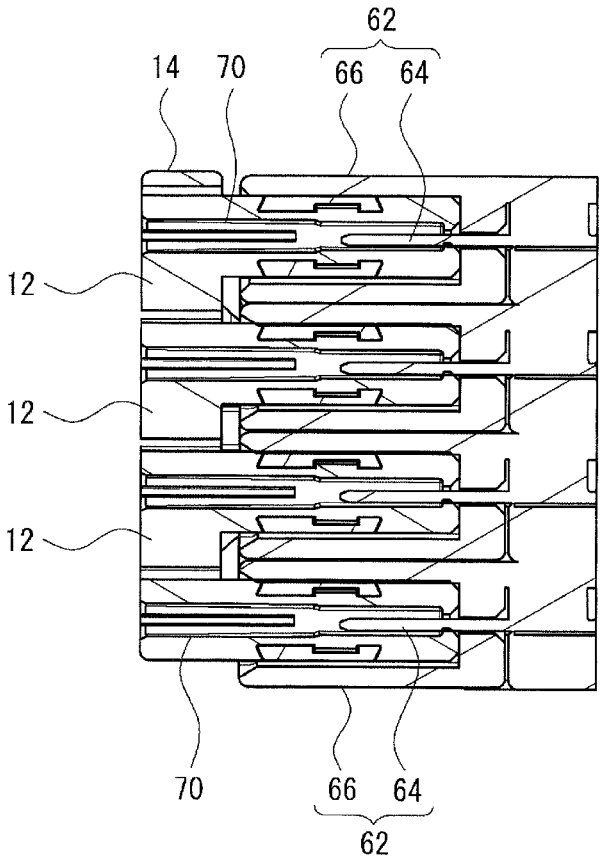
FIG. 16 is a view showing a cross-section when a connected assembly of the connector of the present invention and the mating connectors is cut along forward and backward directions at center positions of the cavities.

A case where the thus configured connector 10 is connected to the mating connectors is described. FIG. 15 is a view showing a state before the connector 10 and the mating connectors 62 are connected. FIG. 16 is a view showing a state where a connected assembly of the connector 10 and the mating connectors 62 is cut along forward and backward directions at center positions of the cavities 12.

Each of the electric/electronic devices (members) 60 such as substrates that are collectively connected by the connector 10 of the present invention includes the mating connector 62 on one end edge. The mating connector 62 includes pin terminals 64 pulled out from the one end edge and receptacles 66 covering the pin terminal 64. In the electric/electronic device (member) 60, two pin terminals 64 are pulled out from the one end edge. Two receptacles 66 individually covering the two pin terminals 64 are coupled to each other by integral molding. The receptacles 66 are in the form of tubes having a rectangular cross-section, the front sides thereof to which the connector 10 of the present invention is to be fitted are open and the receptacles 66 are formed to have such a length as to cover the pin terminals 64.

The thus configured electric/electronic devices (members) 60 are collected and a plurality of electric/electronic devices (members) 60 are stacked in the vertical direction. The mating connectors 62 of the plurality of electric/electronic devices (members) 60 are arranged in the vertical direction into one assembly by being stacked.

A plate-like guide member 68 extending upward to the left side of the two receptacles 66 of the uppermost electric/electronic device (member) 60 is provided on the left side of the two receptacles 66 of the lowermost electric/electronic device (member) 60, and the left side of the two receptacles 66 of each electric/electronic devices (member) 60 is positioned by being brought into contact with this guide member 68. In this way, the mating connectors 62 of the plurality of electric/electronic devices (members) 60 are arranged in the vertical direction into one assembly. Note that a locking claw (not shown) to be engaged with the lock 34 of the connector 10 is provided on the outer left surface of the guide member 68.

Here, when the cavities 12 of the connector 10 of the present invention are inserted into the receptacles 66 of the mating connectors 62, the pin terminals 64 in the receptacles 66 of the mating connectors 62 and the tubular terminals 70 in the cavities 12 of the connector 10 of the present invention are fitted and held in contact and these terminals 64, 70 are electrically connected as shown in FIG. 16.

At this time, even if there is a stacking tolerance between the receptacles 66 arranged in the vertical direction in inserting the cavities 12 of the connector 10 of the present invention into the receptacles 66 of the mating connectors 62, the individual cavities 12 of the connector 10 of the present invention can be positioned with respect to the corresponding receptacles 66, into which the cavities 12 are to be fitted, by being moved, whereby the stacking tolerance can be absorbed. In this way, the plurality of stacked mating connectors 62 can be collectively connected by the connector 10.

Note that although all of the plurality of cavities 12 are permitted to move relative to the holder 14 in the connector 10 of the above embodiment, movements of one or more of the plurality of cavities relative to the holder may be restricted. Since the movements of such cavities relative to the holder are restricted, they can serve as positioning references in connecting the connector of the present invention to the mating connectors. This enables the connector to be more easily connected to the mating connectors.

Since one positioning reference is sufficient in connecting the connector to the mating connectors, there is preferably one cavity whose movement relative to the holder is restricted in terms of ensuring a degree of freedom of the other cavities and enabling a stacking tolerance to be more easily absorbed.

A configuration for restricting the movement of the cavity can be: 1) a configuration for integrally forming the cavity to the holder, 2) a configuration for press-fitting the cavity into the insertion hole of the holder main body, 3) a configuration for integrally molding the cavity to the cover, 2) a configuration for pressing the cavity by the cover or the like. For example, the cavities configured in this way can be a reference cavity.

Although the embodiment of the present invention has been described in detail above, the present invention is not limited to the above embodiment and can be variously modified without departing from the gist of the present invention.

For example, although two cavities 12 are arranged side by side in the lateral direction in the above embodiment, one cavity 12 may be arranged in the lateral direction or three or more cavities 12 may be arranged side by side in the lateral direction. Further, although the cover 32 is provided in the above embodiment, it may not be provided. Further, although the cavities 12 are in the form of rectangular tubes in the above embodiment, they may have another form such as a cylindrical form. Further, the guide grooves 56 formed on the cover 32 penetrate through the cover 32 similarly to the through holes 54 in the above embodiment, they may not penetrate through the cover 32 and may be formed by recessing the outer surface of the cover 32.

The invention claimed is:

1. An electrical connector, comprising:

a connector main body defining a frame having an open rear end, a front wall opposite the open rear end, a plurality of insertion holes formed through the front wall and communicating with the open rear end, locking lances projecting, inward from the frame at positions aligned respectively with the insertion holes, and rearward facing projections formed in the connector main body in proximity to the insertion holes;

a plurality of separate tubular cavities, each of the tubular cavities having opposite front and rear ends, and at least one side wall extending between the front and rear ends, the tubular cavities being inserted into the open rear end of the frame of the connector main body along an insertion direction so that the front end of each of the tubular cavities passes respectively into one of the insertion holes of the connector main body, each of the tubular cavities being locked in the connector main body separately and independently of the other tubular cavities inserted into the connector main body by a respective one of the locks, a stopper projecting from the at least one side wall of each of the tubular cavities at a position on the respective tubular cavity in proximity to the rear end of the respective tubular cavity, each of the stoppers having a forward facing surface that is engageable with one of the rearward facing projections of the connector main body to limit forward movement of the respective cavity in the insertion hole into which the respective tubular cavity is inserted a cover hinged to the connector main body at a position behind the tubular cavities and being closable for preventing rearward detachment of the tubular cavities from the connector main body, a distance between the cover and the rearward facing projections on the connector main body along the insertion direction when the cover is closed being greater than a dimension of the stoppers along the insertion direction so that the tubular cavities can move along the insertion direction relative to the connector main body when the cover is closed; and clearances provided between the tubular cavities and the connector main body in directions transverse to the insertion direction so that the tubular cavities are permitted to move relative to the connector main body by the clearances.

2. The electrical connector of claim 1, further comprising a reference cavity that is fixed relative to the connector main body.

3. The electrical connector of claim 2, wherein the reference cavity is integrally molded to the connector main body so that movement of the reference cavity relative to the connector main body is restricted.

4. The electrical connector of claim 2, wherein the reference cavity is press-fit into the connector main body so that movement of the reference cavity relative to the connector main body is restricted.

5. The electrical connector of claim 2, wherein the reference cavity is integrally molded to the cover so that movement of the reference cavity relative to the connector main body is restricted.

6. The electrical connector of claim 2, wherein the reference cavity is pressed by the cover so that movement of the reference cavity relative to the connector main body is restricted.

7. The electrical connector of claim 6, wherein the cover is formed with at least one through hole through which wires extending from the cavities are passed, the at least one through hole defining a guide groove extending to an outer periphery of the cover for determining a wiring direction of the wires.

8. The electrical connector of claim 1, wherein the cavities of the connector collectively connect to a plurality of mating connectors provided in a stacked array.

9. The electrical connector of claim 1, wherein each of the cavities is configured for accommodating a single terminal fitting.

10. The electrical connector of claim 1, wherein the projections are disposed on sides of the insertion holes opposite the locks.

11. The electrical connector of claim 1, wherein the stoppers project asymmetrically from the cavities, the cavities being oriented so that two of the cavities engage the same projection at positions that overlap in a projecting direction of the respective stoppers.

12. The electrical connector of claim 1, wherein each of the cavities has at least one elongated guide rib, and each of the insertion holes has at least one guide groove configured and disposed for receiving the elongated guide rib when the respective cavity is oriented properly.

13. The electrical connector of claim 1, wherein each of the locks engages with a lance locking hole in the at least one elongated guide rib, and wherein the projections are disposed on sides of the insertion holes opposite the locks.

* * * * *